US005914309A

United States Patent [19]

Ulbl et al.

[11] Patent Number: 5,914,309

[45] Date of Patent: Jun. 22, 1999

[54] PROCESS FOR THE PRODUCTION OF DETERGENT TABLETS BY MICROWAVE AND HOT AIR TREATMENT

[75] Inventors: Mario Ulbl, Essen; Andreas Potthoff, Duesseldorf; Sandra Witt, Langenfeld; Manfred Klemm, Hannover, all of Germany

[73] Assignee: Henkel-Ecolab GmbH & Co. OHG, Duesseldorf, Germany

[21] Appl. No.: 08/836,623

[22] PCT Filed: Oct. 30, 1995

[86] PCT No.: PCT/EP95/04242

§ 371 Date: May 7, 1997

§ 102(e) Date: May 7, 1997

[87] PCT Pub. No.: WO96/14391

PCT Pub. Date: May 17, 1996

[30] Foreign Application Priority Data

Nov. 7, 1994 [DE] Germany ..... 4439679

[51] Int. Cl.[6] ..... C11D 11/00

[52] U.S. Cl. ..... 510/446; 510/457; 34/259; 34/265; 204/157.15; 204/157.43; 159/DIG. 26

[58] Field of Search ..... 510/446, 457; 34/259, 265; 204/157.15, 157.43; 159/DIG. 26

[56] References Cited

U.S. PATENT DOCUMENTS

| | | | |
|---|---|---|---|
| 3,366,570 | 1/1968 | Slob | 510/298 |
| 3,858,329 | 1/1975 | Koide et al. | 34/1 |
| 4,405,850 | 9/1983 | Edgar | 219/10.55 A |
| 4,584,281 | 4/1986 | Foley | 501/85 |
| 4,664,839 | 5/1987 | Rieck | 252/175 |
| 4,816,553 | 3/1989 | Baur et al. | 528/245 |
| 4,820,439 | 4/1989 | Rieck | 252/135 |
| 4,885,108 | 12/1989 | Richter | 510/447 |
| 5,108,646 | 4/1992 | Beerse et al. | 510/532 |
| 5,382,377 | 1/1995 | Raehse et al. | 510/446 |
| 5,501,814 | 3/1996 | Engelskirchen et al. | 252/174.17 |
| 5,541,316 | 7/1996 | Engelskirchen et al. | 510/471 |
| 5,580,941 | 12/1996 | Krause et al. | 527/300 |

FOREIGN PATENT DOCUMENTS

| | | |
|---|---|---|
| 1 004 876 | 2/1993 | Belgium . |
| 164 514 | 12/1985 | European Pat. Off. . |
| 0 280 223 | 8/1988 | European Pat. Off. . |
| 23 27 956 | 12/1974 | Germany . |
| 42 21 381 | 2/1994 | Germany . |
| 43 00 772 | 7/1994 | Germany . |
| WO 93/08251 | 4/1993 | WIPO . |
| WO 93/16110 | 8/1993 | WIPO . |
| WO 94/25563 | 11/1994 | WIPO . |
| 96/06156 | 2/1996 | WIPO . |
| 97/26317 | 7/1997 | WIPO . |

*Primary Examiner*—Lorna Douyon
*Attorney, Agent, or Firm*—Ernest G. Szoke; Wayne C. Jaeschke; Real J. Grandmaison

[57] ABSTRACT

A process for producing detergent tablets by exposing a detergent composition to microwave radiation in the frequency range from 3 to 300,000 MHz while treating the detergent composition with hot air having a temperature of 50° C. to 300° C.

5 Claims, No Drawings

PROCESS FOR THE PRODUCTION OF DETERGENT TABLETS BY MICROWAVE AND HOT AIR TREATMENT

BACKGROUND OF THE INVENTION

1. Field of the Invention

This invention relates to a process for the production of detergent tablets by microwave and hot air treatment.

The disadvantage of conventional detergent tablets which are normally produced by compression molding or fusion is that they do not dissolve sufficiently quickly on account of their compactness so that the active substances are released too slowly. In addition, the rate at which such tablets disintegrate is too low.

2. Discussion of Related Art

Earlier hitherto unpublished International patent application PCT/EP94/01330 now WO 94/25563, to the disclosure of which reference is expressly made, describes in detail the production of washing- and cleaning-active tablets using microwaves which have an extremely high dissolving or disintegrating rate coupled with high breaking strength. A crucial requirement for the production of tablets from powder-form or granular raw materials using microwaves is that the starting materials should be at least partly present in hydrated form, "hydrated" meaning "hydrated under certain conditions in regard to temperature, pressure or relative atmospheric humidity to which the raw material is exposed or with which the raw material is in equilibrium". The term "hydrated" is also defined in PCT/EP94/01330. In general, hydrated starting materials are those which contain bound water of crystallization or which are capable of binding externally added water at least partly as water of crystallization or even those substances which do not form defined hydrates, but which are capable of binding water, for example alkali metal hydroxides.

The expression "microwaves" in the context of the present invention is understood to cover the entire frequency range from 3 to 300,000 MHz, i.e. the frequency range which, in addition to the actual microwave range above 300 MHz, also encompasses the radio wave range from 3 to 300 MHz. This technique can be used to produce so-called macrosolids which, besides tablets, also include blocks for example. To this end, the compounds are joined together at their points of contact with one another by local microwave-induced melting/sintering. The voids present between the individual components of the compounds before exposure to microwaves provide the tablets formed with high porosity and thus contribute towards improving the dissolving properties of the tablets.

To facilitate local sintering of the various components of the compounds, at least some of the components must be capable of sintering at their surface. To this end, the components of the compounds themselves or their surfaces must contain sufficient water so that the components of the compounds melt at their points of contact when the water is heated. According to the teaching of International patent application PCT/EP94/01330, the mixture to be exposed to microwaves must be at least partly present in hydrated form.

In the context of the present invention, therefore, the term "tablets" is not confined to any particular three-dimensional form. In principle, the tablets may assume any three-dimensional form, depending on the shape which the powder-form or granular compounds are made to assume.

The chemical composition of the generally powder-form or granular compounds—and hence the tablets—can be varied over a very broad range, cf. the disclosure of PCT/EP94/01330.

It has now been found that tablets produced by the microwave treatment of powder-form or granular compounds on the one hand lack the breaking strength required for storage and transport if the microwave treatment is too short and, on the other hand, undergo core carbonization if the microwave treatment is too long. Hitherto, it has now always been possible to solve this problem because, in many cases, adequate breaking strength inevitably involved carbonization within the tablet and the avoidance of carbonization resulted in inadequate breaking strength.

Accordingly, the problem addressed by the present invention was to find a process in which the disadvantages mentioned above would not arise, i.e. which would give tablets combining a high breaking strength with the absence of any carbonization.

DESCRIPTION OF THE INVENTION

According to the present invention, the solution to this problem is characterized in that, during its exposure to microwaves, the compound is treated with hot air at a temperature of 50° C. to 300° C., preferably 100° C. to 250° C. and, more preferably, 150° C. to 220° C.

In the context of the invention, the expression "compound" applies to the powder-form and/or granular mixture of detergent ingredients. Suitable detergent ingredients are, in principle, any of the substances which are normally used for the production of solid cleaning formulations for textiles and hard surfaces, cf. in particular the substances disclosed in PCT/EP94/01330.

Suitable builders are, for example, amorphous silicates, such as metasilicates or waterglasses, phosphates, alkali metal carbonates, alkali metal sulfates, zeolites and also organic components, such as water-containing citrates, for example sodium citrate dihydrate, or water-containing acetates, for example sodium acetate trihydrate. Suitable substitutes or partial substitutes for phosphates and zeolites are crystalline layer-form sodium silicates with the general formula $NaMSi_xO_{2x+1}.yH_2O$, where M is sodium or hydrogen, x is a number of 1.9 to 4 and y is a number of 0 to 20, preferred values for x being 2, 3 or 4. Corresponding crystalline layer silicates are described, for example, in European patent application EP-A-0 164 514. Preferred crystalline layer silicates are those in which M is sodium and x assumes the value 2 or 3. Both β- and γ-sodium disilicates $Na_2Si_2O_5.yH_2O$ are particularly preferred.

Useful organic builders are, for example, the polycarboxylic acids preferably used in the form of their sodium salts, such as citric acid, adipic acid, succinic acid, glutaric acid, tartaric acid, sugar acids, aminocarboxylic acids, nitrilotriacetic acid (NTA), providing its use is not objectionable on ecological grounds, and mixtures thereof. Preferred salts are the salts of the polycarboxylic acids, such as citric acid, adipic acid, succinic acid, glutaric acid, tartaric acid, sugar acids and mixtures thereof.

Suitable polymeric polycarboxylates are, for example, the sodium salts of polyacrylic acid or polymethacrylic acid, for example those having a relative molecular weight of 800 to 150,000 (based on acid). Suitable copolymeric polycarboxylates are, in particular, those of acrylic acid with methacrylic acid and those of acrylic acid or methacrylic acid with maleic acid. Copolymers of acrylic acid with maleic acid containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Biodegradable terpolymers are also particularly preferred, for example those containing salts of acrylic acid and maleic acid and also vinyl alcohol or vinyl alcohol derivatives as monomers (P 43 00 772.4) or those containing salts of acrylic acid and 2-alkyl allyl sulfonic acid and also sugar derivatives as monomers (DE 42 21 381).

Other suitable builder systems are oxidation products of carboxy-functional polyglucosans and/or water-soluble salts thereof which are described, for example, in International patent application WO-A-93/08251 or of which the production is described, for example, in International patent application WO-A-93/16110.

Other preferred builders are the known polyaspartic acids and salts and derivatives thereof.

Other suitable builders are polyacetals which may be obtained by reaction of dialdehydes with polyolcarboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthalaldehyde and mixtures thereof, and from polyolcarboxylic acids, such as gluconic acid and/or glucoheptonic acid.

The inorganic and/or organic builders are used in the tablets in quantities of preferably about 10 to 60% by weight and, more preferably, 15 to 50% by weight.

Solid acids, for example amidosulfonic acid or phosphonic acids, are used for the production of acidic detergent tablets.

In addition, the tablets generally contain anionic, cationic, amphoteric or zwitterionic surfactants, but above all the nonionic surfactants disclosed in PCT/EP94/01330. Nonionic surfactants, such as fatty alcohol ethoxylates for example, are preferred. In addition, the tablets may optionally contain oxygen- or chlorine-based bleaching agents, disinfectants, for example quaternary ammonium compounds, foam inhibitors, enzymes, fillers, etc.

The microwave treatment normally lasts 15 seconds to 90 minutes, preferably 1 minute to 30 minutes and, more preferably, 1 minute to 5 minutes.

In another embodiment of the invention, the tablets are treated with hot air after the microwave treatment. In principle, there are no limits to the time interval between the microwave treatment and the hot air treatment although the intervening period is normally at most 24 hours, preferably at most 60 minutes and, more preferably, at most 2 minutes. In principle, the hot air treatment may last for as long as the tablet is capable of withstanding the treatment without damage. For economic reasons, the duration of the hot air treatment is up to 30 minutes, preferably up to 10 minutes and, more preferably, up to 3 minutes.

In a particularly preferred embodiment of the process according to the invention, the treatment with hot air is carried out both during and after the microwave treatment. In this case, too, the time interval between the microwave treatment and the following hot air treatment is normally at most 24 hours, preferably at most 60 minutes and, more preferably, at most 2 minutes. The duration of the hot air treatment is also normally in the range mentioned above.

The hot air is generally produced by a conventional hot air blower with a controllable air temperature.

The microwave treatment may be carried out, for example, in the microwave oven described in PCT/EP94/01330. The products thus microwaved may then be subjected to a hot air treatment. The microwave treatment and the hot air treatment may also be carried out simultaneously in the oven. Accordingly, the microwave treatment and/or hot air treatment may be carried out in batches in a single unit, for example an oven, as described above.

The microwave treatment (accompanied or followed by the hot air treatment or accompanied and followed by the hot air treatment) may be carried out continuously. To this end, the compounds to be microwaved are transported on a conveyor belt through a microwave radiation zone. In addition, hot air is blown either directly into the radiation zone or into a zone immediately adjoining the radiation zone or both into the radiation zone and into the adjoining zone.

EXAMPLES 60 g of powder-form compounds (corresponding to formulations 1 and 2 below) were brought into the required shape by manual precompaction or by precompaction in a pneumatic press under a pressure of 1 to 400 N/cm$^2$ and were then optionally removed from the container. "Manual precompaction" means that the compound introduced into a container open on top is manually compressed from above with a stamp. The pressure applied for manual precompression is of the order of 1 to 20 N/cm$^2$. Where a pneumatic press is used, the pressure applied is of the order of 200 to 400 N/cm$^2$. [The manually precompressed compounds were generally more soluble after microwaving and hot air treatment in accordance with the invention.] The precompactates were then placed on a conveyor belt and transported through a microwave radiation zone in which they were not subjected to any treatment with hot air.

Working conditions

| | |
|---|---|
| Conveyor speed | 47 cm per minute |
| Length of the microwave radiation zone | 210 cm |
| Microwave source | 18 microwave emitters each with an output of 1200 watts, wavelength 2450–2470 MHZ |
| Distance of microwave source from conveyor belt | 9 emitters at 11 cm<br>9 emitters at 4 cm |

These conditions are defined as "standard conditions".

| | |
|---|---|
| Formulation 1: | |
| aminosulfonic acid | 96% by weight |
| octane phosphonic acid | 1% by weight |
| $C_{12-18}$ fatty alcohol ethoxylate | 1% by weight |
| $Na_2SO_4$ | 1% by weight |
| $H_2O$ | 1% by weight |
| Formulation 2: | |
| pentasodium triphosphate | 40% by weight |
| sodium metasilicate | 40% by weight |
| sodium metasilicate pentahydrate | 10% by weight |
| sodium carbonate decahydrate | 5% by weight |
| dimethyl dioctyl ammonium chloride | 3% by weight |
| $C_{12-18}$ fatty alcohol ethoxylate | 2% by weight |

To increase the output of the assembly line, both the speed of the conveyor belt and the microwave power were doubled in relation to the standard conditions. Unfortunately, the tablets thus obtained had unsatisfactory breaking strength. However, a reduction in the conveyor speed resulted in carbonization within the tablets.

When the non-breakage-resistant tablets produced at twice the conveyor speed and twice the microwave power were treated with hot air (200° C.) for 2 minutes 45 seconds after microwaving, breakage-resistant tablets with no sign of carbonization were obtained.

When the conveyor speed and the microwave power were again doubled, the duration of the hot air treatment had to be increased to 7 minutes 20 seconds to obtain breakage-resistant tablets.

What is claimed is:

1. A microwave process for producing detergent tablets comprising precompacting a detergent composition under a pressure of 1 to 400 $N/cm^2$, transporting said detergent composition on a conveyor belt through a microwave radiation zone at a conveyor speed of at least 94 cm/minute, exposing said detergent composition to microwave radiation in the frequency range from above 300 to 300,000 MHz and treating said detergent composition from about 2 to 30 minutes with hot air having a temperature of 200° C. to 300° C. within 60 minutes of exposing said composition to said microwave radiation, wherein said microwave radiation has an output effective to produce break-resistant tablets without carbonization.

2. A process as in claim 1 wherein said detergent composition contains at least one partially hydrated component.

3. A process as in claim 1 conducted in batch-wise manner.

4. A process as in claim 1 wherein said detergent composition comprises amorphous silicates, crystalline silicates, phosphates, carbonates, sulfates, zeolites and organic compounds.

5. A process as in claim 1 wherein said microwave radiation is for 15 seconds to 90 minutes.

* * * * *